United States Patent [19]

Bruns, deceased

[11] Patent Number: 4,570,516

[45] Date of Patent: Feb. 18, 1986

[54] MAT BOARD CUTTER WITH WEAR ADJUSTABLE CUTTER-CARRYING BODY

[75] Inventor: Carl H. Bruns, deceased, late of Overland Park, Kans., by Ann St. John Bruns, executrix

[73] Assignee: Minnesota Mining and Manufacturing Company, Saint Paul, Minn.

[21] Appl. No.: 662,625

[22] Filed: Oct. 19, 1984

[51] Int. Cl.[4] ..... B26D 3/02; B26D 7/02

[52] U.S. Cl. ..... 83/455; 83/614; 83/635; 83/829; 308/3 R

[58] Field of Search ..... 83/455, 614, 581, 821, 83/828, 829, 635; 30/293, 294; 308/3 R, 3 A

[56] References Cited

U.S. PATENT DOCUMENTS

| | | | |
|---|---|---|---|
| 3,436,129 | 4/1969 | James | 308/3 R |
| 3,446,180 | 5/1969 | Palmer | 308/3 R |
| 4,036,486 | 7/1977 | Molpus | 269/303 |
| 4,413,542 | 11/1983 | Rempel | 83/455 |
| 4,440,055 | 4/1984 | Gelfand | 83/614 X |

*Primary Examiner*—James M. Meister

*Attorney, Agent, or Firm*—Donald M. Sell; James A. Smith; William L. Huebsch

[57] ABSTRACT

A mat board cutter including a cutter-carrying body having an end-to-end channel receiving a guide rail on which the body is slideably mounted. A plurality of slippery polymeric wear buttons project from a bottom surface of the body and bear against an upper surface of a clamp bar under the rail, and the amount of projection of at least one of the wear buttons is adjustable to provide close fitting accurate sliding relationship between the body and the guide rail.

6 Claims, 6 Drawing Figures

MAT BOARD CUTTER WITH WEAR ADJUSTABLE CUTTER-CARRYING BODY

TECHNICAL FIELD

The present invention relates to mat board cutters, and particularly to means for adjusting the accuracy with which a cutter-carrying body slides along a path defined by a guide rail on such a mat board cutter.

BACKGROUND ART

U.S. Pat. No. 4,036,486, incorporated herein by reference, describes a mat board cutter by which a mat board is cut to have a desired peripheral size to fit within a desired frame and to have a desired central opening through which a picture being framed is visible.

As described in greater detail in U.S. Pat. No. 4,036,486, cutting the mat board requires sliding a cutter-carrying body along a path defined by a guide rail with a knife on a cutter device pivotably carried on the body in engagement with the mat, which mat is held in a predetermined position by abutment means on a base and a clamp bar having an upper surface along which the guide rail is mounted. The body has a channel that is defined by an almost fully cylindrical surface, opens through end surfaces and a bottom surface of the body, and receives the rail. The almost fully cylindrical surface provides (or supports a structure such as a strip of tape that provides) a bearing surface which engages a guide surface along the rail to insure that the body accurately slides along the path defined by the rail, since movement other than linear sliding movement of the body along the rail can result in an irregular or non-linear cut edge on the mat board. A body 10 for one less expensive variety of such a mat board cutter sold under the trade designation "Art Mate" by Minnesota Mining and Manufacturing Company, Saint Paul, Minnesota, is shown in FIG. 1 of the drawing. That body 10 has an almost fully cylindrical surface 12 defining such a channel, which surface 12 has a sufficiently large diameter to provide clearance between the surface 12 and a guide surface on a cylindrical rail (not shown) along which the body is guided. Several lengths 16 of pressure sensitive adhesive coated "teflon" tape are applied to the body 10 along the surface 12 and a bottom surface 18 of the body 10 to provide bearing surfaces for the body 10 against the guide surface of the rail and the upper surface of the clamp bar under the rail to afford accurate linear movement of the body along the rail. With use, however, wear on the lengths 16 of tape, or pealing away of one or more of the lengths 16 of tape can allow the body 10 to be moved out of its intended path defined by the rail so that cuts made by the knife are not as straight as may be desired.

DISCLOSURE OF THE INVENTION

The present invention provides an inexpensive cutter-carrying body for a mat board cutter of the type described above, which body is easily adjustable to bring a bearing surface of the body into close fitting sliding engagement with a guide surface of a guide rail to afford accurate sliding movement of the body along the linear path defined by the rail either upon assembly or after lengths of tape providing a bearing surface on the body have become worn or removed, or when a bearing surface provided by the rail or the body itself has become worn.

According to the present invention there is provided a mat board cutter of the type described above having a base with means for positioning a mat board thereon; a clamp bar for clamping the mat board on the base and having an upper surface; a guide rail fixed along the upper surface on the clamp bar having a peripheral guide surface; a cutter-carrying body having spaced ends, a bottom surface; a channel defined by surface which opens through the end surfaces and bottom surface of the body and receives the guide rail with the bottom surface of the body closely spaced from the upper surface of the clamp bar so that a bearing surface in the channel provided by the body (or a structure mounted on the body) can slide along and be guided by the peripheral guide surface of the rail; and at least one cutter device including a knife which is pivotably mounted on the cutter-carrying body for movement between a disengaged position with the knife spaced from the mat board and an engaged position with the knife engaged with the mat board. In the improved mat board cutter according to the present invention the cutter-carrying body has a plurality of spaced slippery polymeric wear buttons projecting from its bottom surface and positioned against the upper surface of the clamp bar, and means are provided for adjusting the amount of projection of at least one of the wear buttons from the bottom surface to position the bearing and guide surfaces in close-fitting slideable relationship to afford accurate sliding movement of the body along the rail.

In one embodiment described herein the cutter-carrying body has two spaced wear buttons along the bottom surface of both sides of the channel and the means for adjusting is adapted to adjust the amount of projection for each of the wear buttons from the bottom surface; whereas in another presently preferred embodiment the cutter-carrying body has two spaced fixed wear buttons along the bottom surface on one side of the channel, and a single wear button adjustable by the means for adjusting centered along the bottom surface on the other side of the channel.

BRIEF DESCRIPTION OF DRAWING

The present invention will be further described with reference to the accompanying drawing wherein like reference numerals refer to like parts in the several views, and wherein.

DETAILED DESCRIPTION OF THE PREFERRED EMBODIMENTS

Figure 2:
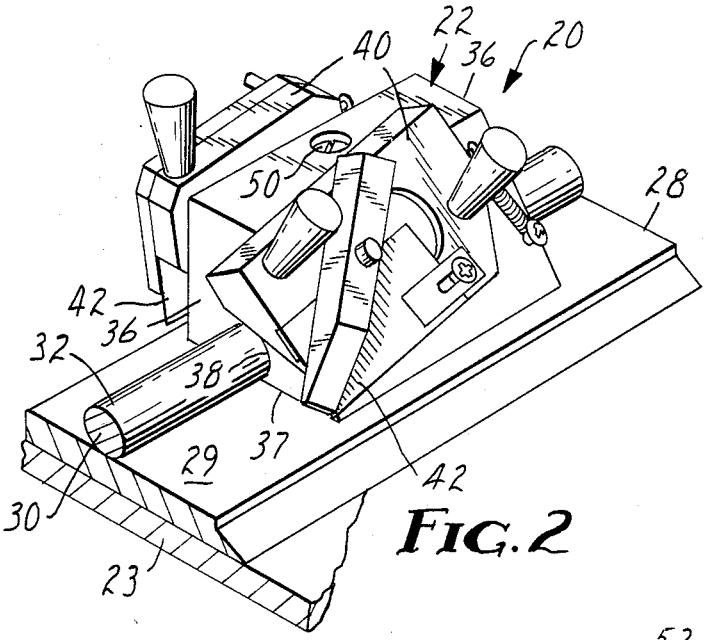
FIG. 2 is a fragmentary perspective view of a mat board cutter including a first embodiment of a cutter-carrying body according the present invention.
Figure 1:
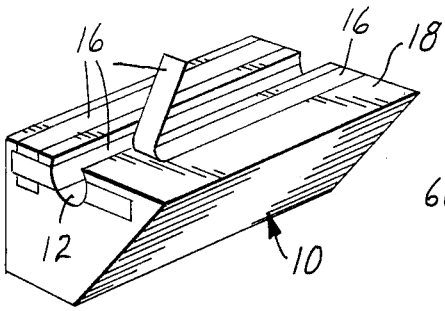
FIG. 1 PRIOR ART
FIG. 1 is an inverted perspective view of a cutter-carrying body used in a prior art mat board cutter described above.
Figure 3:
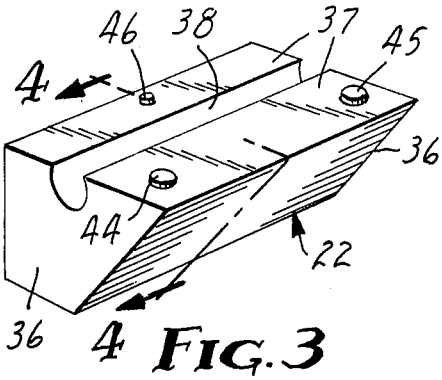
FIG. 3 is an inverted perspective view of the cutter-carrying body used in the mat board cutter shown in FIG. 2 which has the other parts removed to show details.
Figure 4:
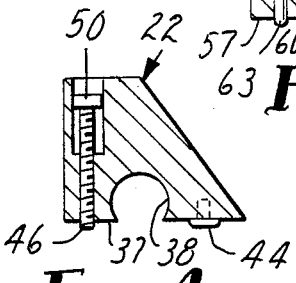
FIG. 4 is a reduced sectional view taken approximately along line 4—4 of FIG. 3 and rotated about 180 degrees.

Referring now to FIGS. 2 through 4 of the drawing there is shown a portion of a mat board cutter 20 including a first embodiment of an improved cutter-carrying body 22 according to the present invention.

The mat board cutter 20, which is similar to the mat board cutter described in U.S. Pat. No. 4,036,486 incorporated herein by reference, comprises a base 23, with abutment means (not shown) for positioning a mat board thereon; a clamp bar 28 for clamping the mat board on the base 23, which clamp bar 28 has an upper surface 29; a guide rail 30 fixed to the clamp bar 28 along its upper surface 29 and having a cylindrical peripheral guide surface 32; the cutter-carrying body 22 which has spaced end surfaces 36 and a channel 38 defined by an almost fully cylindrical surface, which channel 38 opens through the end surfaces 36 and opens along one side through a planar bottom surface 37 on the body 22, which channel 38 receives the guide rail 30 in sliding relationship so that the almost fully cylindrical surface that defines the channel provides a bearing surface on the body 22 that can slide along and will be guided by the peripheral guide surface 32 of the guide rail 30 while the bottom surface 37 of the body 22 moves in closely spaced relationship along the upper surface 29 of the clamp bar 28; and two cutter devices 40 each including a knife 42 and being pivotably mounted on a side surface of the cutter-carrying body 22 for pivotal movement between a disengaged position with the knife 42 spaced from the mat board, and an engaged position with the knife 42 engaged with the mat board.

As can best be seen in FIGS. 3 and 4, the improved cutter-carrying body 22 has a plurality of, or three, spaced slippery polymeric (e.g., nylon (RTM) wear buttons 44, 45, and 46 projecting from its bottom surface 37 and adapted to bear against and slide along the upper surface 29 of the clamp bar 28. Means are also provided for adjusting the amount of projection of the wear button 46 from the bottom surface 37 to afford positioning the bearing surface of the body 22 within the channel 38 and the guide surface 32 of the rail 30 in close-fitting relatively slidable relationship by changing the spacing between the top surface 29 of the clamp bar 28 and the bottom surface 37 of the body 22. As illustrated, the cutter-carrying body 22 is a one-piece block of a suitable bearing metal (e.g., manganese bronze). The two wear buttons 44 and 45 are mushroom shaped, each having stem like portions fixed in the body 22 as by friction or adhesive, and head-like portions projecting from the bottom surface 37 in spaced relationship on one side of the channel 38. The adjustable wear button 46 is defined by the end portion of a polymeric screw threadably engaged in the body 22, and having a slotted head 50 accessible through an opening in the upper portion of the body 22 (see FIGS. 2 and 4) to afford adjusting the projection of the wear button 46 by the use of a conventional screwdriver. The wear button 46 projects from the bottom surface 37 at a central location on the side of the channel 38 opposite the fixed wear buttons 44 and 45 so that the three wear buttons 44, 45, and 46 provide 3 point support for the body 22 on the upper surface 29.

Adjusting the wear button 46 to provide a close fitting relatively slideable relationship between the body 22 and the guide rail 30 brings parts of the almost fully cylindrical surface defining the channel 38 on both sides of the channel opening through the bottom surface 37 of the body 52 that diverge from adjacent the bottom surface 37 into sliding engagement with parts of the guide surface 32 on both sides of the rail 40 adjacent the upper surface 29 of the clamp bar 28 that diverge from adjacent the upper surface 29, so that any clearance between the body 22 and rail 30 is adjacent the upper portion of the guide surface 32. Thus, that upper portion of the guide surface 32 need not correspond in shape to the channel (e.g. may be out of round or flatted) and will still not affect the movement of the body 22.

Figure 5:
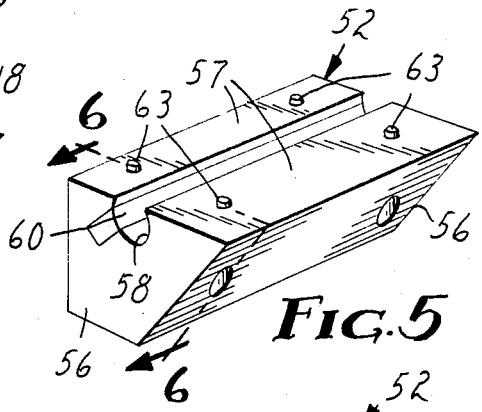
FIG. 5 is an inverted perspective view of a second embodiment of a cutter-carrying body according to the present invention that can be used in a mat board cutter.
Figure 6:
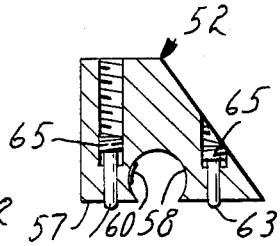
FIG. 6 is a reduced sectional view taken approximately along line 6—6 of FIG. 5 and rotated about 180 degrees.

Referring now to FIGS. 5 and 6 of the drawing there is shown a second embodiment of an improved cutter-carrying body 52 according to the present invention which could be substituted for the body 22 in the mat board cutter 20. Like the cutter-carrying body 22 the body 52 has spaced end surfaces 56 and a channel 58 defined by an almost fully cylindrical surface, which channel 58 opens through the end surfaces 56 and opens along one side through a planar bottom surface 57 on the body 22. The channel 58 could receive the guide rail 30 in sliding relationship so that a bearing surface within the channel provided (as illustrated) both by the body 52 and a length of polymeric tape 60 adhered to the body 52 could slide along and be guided by the peripheral guide surface 32 of the guide rail 30 while the bottom surface 57 of the body 22 moves in closely spaced relationship along the upper surface 29 of the clamp bar 28; and can carry the two pivotably mounted cutter devices 40.

The improved cutter-carrying body 52 has a plurality of, or four, spaced slippery polymeric (e.g., nylon (RTM)) wear buttons 63 projecting from its bottom surface 57 adjacent its channel 58 which can be positioned to bear against and slide along the upper surface 29 of the clamp bar 28. Means are also provided for adjusting the amount of projection of all four wear buttons 63 from the bottom surface 57 to afford positioning parts of the bearing surface of the body 52 within the channel 58 that diverge from adjacent the bottom surface 57 in close-fitting relatively slidable relationship with parts of the guide surface 32 of the rail 30 that diverge from adjacent the upper surface 29 by changing the spacing between the upper surface 29 of the clamp bar 28 and the bottom surface 57 of the body 52. The cutter-carrying body 52 is a one-piece structure of a suitable bearing metal. The four wear buttons 63 are cylindrical and are slideably received in a close fitting cylindrical cavities in the body 52 with portions having rounded ends projecting from the bottom surface 57 in spaced relationship on both sides of the channel 58. The length of the projecting portion of each button 63 is defined by the position of a set screw 65 at its inner end, which set screw 65 is threadably engaged with walls defining a socket in the body 52, and has a six sided socket in its end which is accessible through an open end of the socket in the upper portion of the body 52 (see FIG. 2) to afford adjusting the projection of the wear button 46 by the use of a conventional allen wrench.

Two wear buttons 53 project from the bottom surface 37 from spaced locations on each side of the channel 58 so that the wear buttons 53 afford 4 point support for the body 52 on the upper surface 29.

We claim:

1. In a mat board cutter having a base with means for positioning a mat board thereon; a clamp bar for clamping the mat board on said base and having an upper surface; a guide rail fixed along said upper surface on said clamp bar and having a peripheral guide surface including guide surface parts on both sides of said guide rail diverging from adjacent said upper surface; a cutter-carrying body having spaced end surfaces, a bottom surface, a channel defined by a surface which provides, or supports a member that provides a bearing surface for said body within said channel, said channel opening through said end surfaces, opening along one side through said bottom surface and receiving said guide rail with said bottom surface closely spaced from said upper surface of said clamp bar so that said bearing surface can slide along and be guided by said peripheral guide surface and said bearing surface having parts on both sides of said opening along one side diverging from adjacent said bottom surface; and at least one cutter device including a knife pivotably mounted on said cutter-carrying body for movement between a disengaged position with the knife spaced from the mat board and an engaged position with the knife engaged with the mat board, the improvement wherein:

said cutter-carrying body has a plurality of spaced slippery polymeric wear buttons projecting from said bottom surface adjacent said channel and positioned against the upper surface of said clamp bar, and means are provided for adjusting the amount of projection of at least one of said wear buttons from said bottom surface to position said parts of said bearing and guide surfaces in close-fitting slideable relationship.

2. A mat board cutter according to claim 1 wherein said cutter-carrying body has two spaced wear buttons along said bottom surface on each side of said channel and said means for adjusting is adapted to adjust the amount of projection for each of said wear buttons from said bottom surface.

3. A mat board cutter according to claim 1 wherein said cutter-carrying body has two spaced fixed wear buttons along said bottom surface on one side of said channel and a single wear button adjustable by said means for adjusting centered along said bottom surface on the other side of said channel.

4. In a cutter-carrying body adapted for use in a mat board cutter having a base with means for positioning a mat board thereon, a clamp bar for clamping the mat board on said base and having an upper surface, and a guide rail fixed along said upper surface of said clamp bar and having a peripheral guide surface including guide surface parts on both sides of said guide rail diverging from adjacent said upper surface, said body being adapted to pivotally carry at least one cutter device including a knife for movement between a disengaged position with the knife spaced from the mat board and an engaged position with the knife engaged with the mat board, said cutter-carrying body having spaced end surfaces, a bottom surface, a channel defined by a surface which provides, or supports a member that provides, a bearing surface for said body within said channel, said channel opening through said end surfaces, opening along one side through said bottom surface and being adapted to receive said guide rail with said bottom surface closely spaced from said upper surface of said clamp bar so that said bearing surface can slide along and be guided by said peripheral guide surface and said bearing surface having parts on both sides of said opening along one side diverging from adjacent said bottom surface, the improvement wherein:

said cutter-carrying body has a plurality of spaced slippery polymeric wear buttons projecting from said bottom surface adjacent said channel and adapted to be positioned against the upper surface of said clamp bar, and means are provided for adjusting the amount of projection of at least one of said wear buttons from said bottom surface to afford positioning said bearing and guide surfaces in close-fitting slideable relationship.

5. A cutter-carrying body according to claim 4 having two spaced wear buttons along said bottom surface on both sides of said channel said means for adjusting being adapted to adjust the amount of projection for each of said wear buttons from said bottom surface.

6. A cutter-carrying body according to claim 4 having two spaced fixed wear buttons along said bottom surface on one side of said channel and a single wear button adjustable by said means for adjusting centered along said bottom surface on the other side of said channel.

* * * * *